United States Patent [19]

Yeeda

[11] 4,216,968

[45] Aug. 12, 1980

[54] SELF-SCORING MULTIPLE FUNCTION DART GAME

[76] Inventor: David Yeeda, 6531 Dykes Way, Dallas, Tex. 75230

[21] Appl. No.: 950,467

[22] Filed: Oct. 11, 1978

[51] Int. Cl.[3] ..... F41J 5/04

[52] U.S. Cl. ..... 273/376; 200/5 A; 364/709

[58] Field of Search ..... 364/709; 200/5 A; 273/102.2 R

[56] References Cited

U.S. PATENT DOCUMENTS

| | | | |
|---|---|---|---|
| 1,569,727 | 1/1926 | Donato | 273/102.2 R |
| 2,501,218 | 3/1950 | Hill | 273/102.2 A |
| 2,693,959 | 11/1954 | Ross | 273/102.2 A |
| 2,863,665 | 12/1958 | Gerosolina | 273/102.2A |
| 3,206,196 | 9/1965 | Jackson | 273/103 |
| 3,454,276 | 7/1969 | Brenkert et al. | 273/102.2 R |
| 3,582,076 | 6/1971 | Keller | 273/102.2 A |
| 3,860,771 | 1/1975 | Lynn et al. | 200/5 A |
| 3,995,126 | 11/1976 | Larson | 200/5 A |
| 3,996,427 | 12/1976 | Kaminskz | 200/5 A |
| 4,046,975 | 9/1977 | Seeger | 220/5 A |
| 4,046,981 | 9/1977 | Johnson et al. | 200/5 A |
| 4,055,755 | 10/1977 | Nakamura et al. | 364/709 |
| 4,127,758 | 11/1978 | Lowthop | 200/5 A |
| 4,142,723 | 3/1979 | Rief | 273/102.2 R |
| 4,158,230 | 6/1979 | Washizuka et al. | 364/709 |

*Primary Examiner*—Anton O. Oechsle
*Attorney, Agent, or Firm*—Jan A. Muddle

[57] ABSTRACT

A dart game having self-scoring and display means wherein the scoring is achieved by electronic computation after series actuation of various alphabetical, numerical or mathematical function inputs by an impact-type dart. A target panel comprises an array of individual alpha-numeric and mathematical function strike areas which will effect closing one of a plurality of associated pairs of contact points when impacted by the dart to thereby provide one entry of a plural-entry logic circuit. Upon completion of a predetermined number of entries by a player, the logic circuitry performs a mathematical function in accordance with the entry sequence and displays the result on a display board.

9 Claims, 4 Drawing Figures

SELF-SCORING MULTIPLE FUNCTION DART GAME

BACKGROUND OF THE INVENTION

The invention relates to dart games and more specifically to a dart game having a dart board which included means for electronically computing and displaying the results thereof to a player after the player has impacted a series of darts against individual target areas on the board.

Some prior art dart games including electrical means, provide a plurality of target areas having normally open switch means which are connected to illuminating means for indicating the strike position of a metal tipped dart which pierces a target area to effect closing of the associated switch means by bridging the same through its metal tip. Two such types of dart games are disclosed in U.S. Pat. No. 2,501,218 issued to J. D. Hill and in U.S. Pat. No. 2,693,959 issued to A. D. Ross, Jr.

Other prior art dart games including electrical means, provide a plurality of target areas having normally open conductive means on their surfaces which are closed by a conductive projectile as it contacts portions of the conductive means and is retained thereby by some force e.g. magnetic or gravity. Two such types of dart games are disclosed in U.S. Pat. No. 2,863,665 issued to S. R. Gerosolina and U.S. Pat. No. 3,582,076 issued to C. A. Keller respectively.

Other prior art dart games included means for electrically indicating via illuminating means, the impact area of a projectile which is momentarily impacted against but does not remain against the target area. Two such dart games are disclosed in U.S. Pat. No. 3,206,196 issued to C. E. Jackson and U.S. Pat. No. 1,569,727 issued to P. Donato.

All of these prior art devices use electrical means for indicating the position on the target area struck by the dart or projectile but none of them provide electronic computations of mathematical functions in response to a series of target area strikes as does the present invention.

Another prior art dart game as shown in U.S. Pat. No. 3,454,276 issued to W. D. Brenkert et al discloses a dart game which utilizes electro-mechanical means for effecting counting sequences in response to successive target area impacts by a dart and indicates the cumulative results of the counting sequences on a display board after each impact. This prior art device is limited to simple arithmetic addition of successive inputs as each dart is impacted against various target areas and like the other prior art devices mentioned above, does not have the capability for performing different mathematical functions in response to a series of target area impacts thereby limiting the numerous possibilities of applications relating to the aspects of a player's skill and to the elements of chance which are available with the present invention. The Brenkert et al device also requires rather cumbersome means for providing the plurality of individual displaceable target areas utilized therein.

SUMMARY OF THE INVENTION

An object of the present invention is to provide a self scoring dart game of novel and lightweight construction.

Another object of the present invention is to provide a self scoring dart game having electronic means for computing different mathematical functions in response to a series of dart impacts.

Another object of the present invention is to provide a self scoring dart game utilizing solid-state electronic technology including integrated circuitry and an electronic display system.

The invention resides in a dart game which is self scoring and which comprises a target panel having an array of individual target areas adapted to produce electrical signals upon impact by a dart, logic means responsive to said signals for performing one of a plurality of different mathematical functions upon receiving at least two electrical signals and display means for indicating the result of a mathematical function performed by said logic means.

DESCRIPTION OF THE PREFERRED EMBODIMENT

Figure 1:
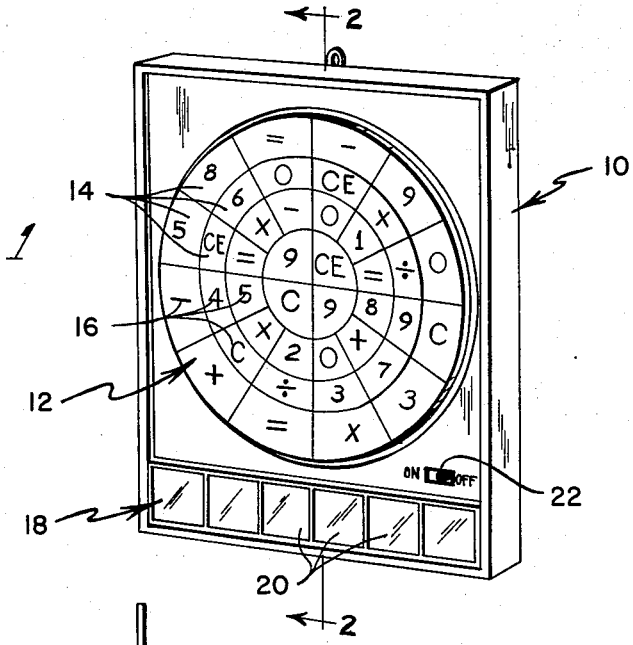
FIG. 1 is a front perspective view of a dart game according to the present invention.

As shown in FIG. 1 the dart game of the present invention is comprised of a housing 10 constructed of a lightweight rigid material such as plastic, having on the front wall thereof a target panel 12 which includes a plurality of target areas 14 including various numerical and mathematical function indicia 16 indicated thereon. The housing 10 also includes a display area 18 having a plurality of digital read out panels 20 and a power on-off switch 22. Electrical power for the electronic circuitry (to be discussed later) and the display area read out may be provided by connection thereof to a conventional AC source through a power cord or by a suitable connection to a DC source provided by batteries (not shown).

Figure 2:
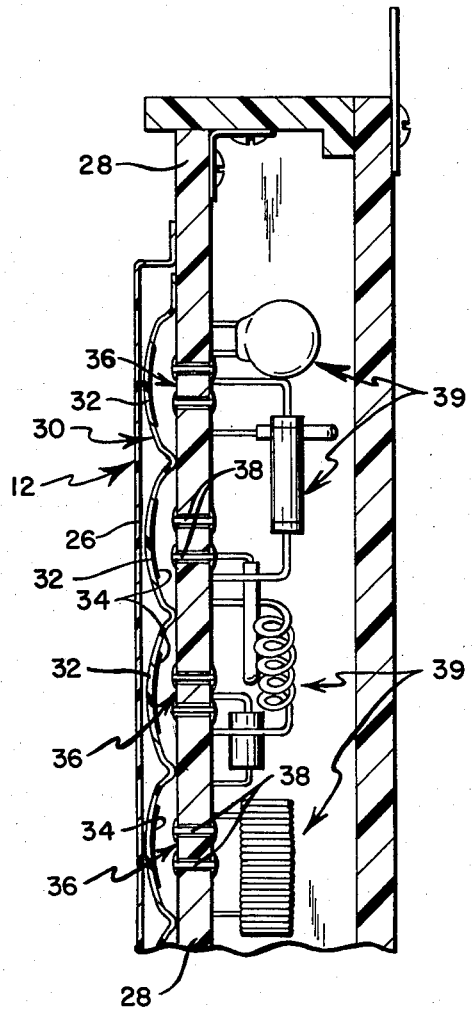
FIG. 2 is a partial sectional view on an enlarged scale taken along line 2—2 of FIG. 1.
Figure 3:
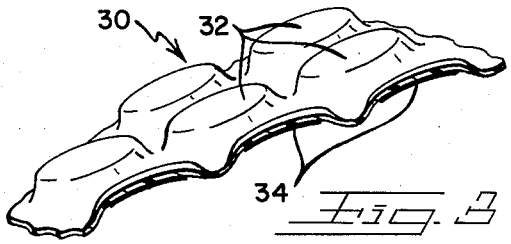
FIG. 3 is a perspective view of a section of a moulded flexible sheet used to effect the closing of associated electrical contacts when impacted by a dart.

Referring now to FIG. 2 the target panel 12 is constructed of a thin, semi-rigid plastic sheet 26 and is adhesively affixed to the housing front panel 28 for providing the surface which is to be impacted by the dart when thrown by a player. Directly behind the target panel 26, also adhesively affixed to the front panel 28, is a moulded thin plastic sheet 30 which has a plurality of small circuit-closing domes 32 (FIG. 3), each of which has a coating 34 of conductive material such as copper on its underside.

The housing panel 28 consists of a two sided circuit board having a plurality of contact point pairs 36 on its front side and on its rear side, a conventional but suitable printed circuit which is connected to the contact point pairs 36 by way of plated through holes 38. The printed circuit on the rear side of circuit board 28 is appropriately equipped with suitable solid-state components as is diagramatically illustrated by the numerals 39 so as to provide the standard type mathematical computations and functions set forth later in the description.

Figure 4:
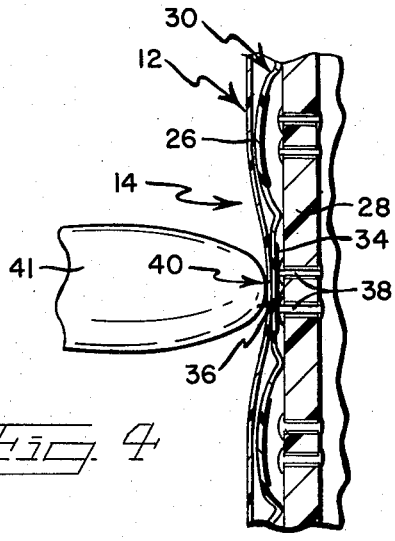
FIG. 4 is a sectional view, of a portion of FIG. 2 illustrating the closing of a set of contacts by an impacting dart.

Referring now to FIG. 4 the moulded construction of the circuit-closing sheet 30 and the flexibility of the semi-rigid target panel sheet 26 are such that when the blunt end 40 of a thrown dart 41 impacts against a specific target area 14 of the target panel 12 one of the domes 32 of the sheet 30 will collapse due to the force of the impacting dart 40, to a condition whereby the conductive coating 34 on the dome under surface momentarily bridges a corresponding pair of contact points 36 on the front side of the circuit board 28 thereby closing the contact pair and producing an electrical signal input to the logic means of the electronic circuitry.

The above description of the preferred embodiment does not in any way imply that other circuit completion techniques, initiated by an impacting dart are excluded, or deemed unsuitable for use in this invention. Thus, substitution of the above described embodiment by, for example a capacitive switching technique, hall-effect switching technique or pressure responsive conductive elastomeric switching technique, would be well within the spirit and scope of the present invention.

DESCRIPTION OF THE ELECTRONIC CIRCUITRY

The electronic circuitry for performing different mathematical computations and functions and displaying their results on the display read out panel 20 is similar to that of a conventional solid state calculator with integrated circuitry. The only difference is that the electronic circuit of the present invention is adapted to receive the same specific type of numerical or mathematical function input thereto from more than one particular pair of contact points 36. This is due to 1) each target area 14 having a plurality of associated domes 34 and pairs of contact points 36 lying thereunder, any of which may be actuated by an impacting dart and 2) corresponding target areas which have the same numerical or mathematical function but different physical locations on the target panel 12.

Each target area 14 may be associated, for example via its plurality of associated pairs of contact points 36 and the conventional electronic calculator integrated circuitry, with one of the following conventional numerical or mathematical function symbols: 0,1,2,3,4,5,6,7,8,9, C (clear), CE (clear error), =(equals), ÷(divide), ×(multiply), +(add), or −(subtract).

The display area read out panels 20 are the same in function and in electronic association with the circuitry of the present invention as are those in a conventional electronic calculator and may be of the liquid crystal (1*c*), light emitting diode (led), nixie tube, vacuum fluorescent type or their like.

The dart game of the present invention is open to many possible methods of playing i.e. number of dart throws per player per turn, number of turns per game etc. However for the purpose of the following illustration of the present invention it will be assumed that a player's turn consists of a series of four "throws" of a dart against the target panel 12. The numerical read out shown on the display panel 20 after the player has thrown his four darts will be a result of the particular combination and sequence of inputs to the electronic circuitry which correspond to the four target areas struck during the player's turn. After each player's turn, in order to "clear" the display panels 20, the switch 22 may be turned to the "off" position and then back to the "on" position or a player may simply press one of the target areas marked "C" (clear). Cumulative totals may be kept of any number of successive turns for each player to complete a game if desired.

The total number of possible results (not all of which are different) for a dart game using the combination of numerals and mathematical functions as illustrated herein is 83,521. A few of these possible results are shown in the following table for illustrative purposes.

| First throw | 2nd throw | 3rd throw | 4th throw | Result |
|---|---|---|---|---|
| 7 | 5 | − | = | 0 |
| 2 | × | 6 | + | 12 |
| 8 | CE | + | 3 | 3 |
| C | 2 | 9 | 4 | 294 |
| 9 | 9 | 9 | 9 | 9999 |
| × | 6 | = | 8 | 8 |
| 8 | ÷ | 3 | = | 2.66666 |

The electronic circuitry of the present invention could of course be modified so as to perform additional mathematical functions i.e. % (percent) and √ (square root) to those illustrated herein or could be substituted in place of some of those illustrated herein without departing from the spirit or scope of the present invention.

Also the numeric or mathematical function symbols 16 illustrated herein may be substituted with words or symbols which may depict planets, animals, sports teams, poker hands etc. for providing different types of game variations without departing from the spirit or scope of the present invention.

Accordingly it is obvious that modifications of the present invention may be made by persons skilled in the art without departing from the spirit or scope of the present invention as set forth in the following claims and it is evident that the example of the present invention described herein is given for illustrative purposes only and should not be limited to the specific embodiment shown.

What is desired to be secured by Letters Patent is:

1. A self scoring dart game comprising a target panel having an array of individual target areas each identified by an individual symbol, each of said areas having at least two independent signal producing means associated therewith, the signal producing means associated with each of said target areas being adapted to produce substantially identical electronic signals upon being impacted by a dart, logic means responsive to said signals for performing one of a plurality of different mathematical functions upon receiving at least two electronic signals, and display means for indicating the result of a mathematical function performed by said logic means.

2. A self scoring dart game as set forth in claim 1 wherein said logic means is comprised of solid state electronics and integrated circuitry.

3. A self scoring dart game as set forth in claim 1 further including a two-sided circuit board having a plurality of pairs of contact points positioned on one side thereof and said logic means positioned on the other side thereof and means for conductively interconnecting said pairs of contact points to said logic means through said circuit board.

4. A self scoring dart game as set forth in claim 3 further including a single element intermediate said target panel and said circuit board for bridging any pair of said contact points to produce said electrical signal.

5. A self scoring dart game as set forth in claim 4 wherein said single intermediate element comprises a moulded sheet of plastic material having a plurality of discrete electrically conductive areas thereon for bridging said contact points.

6. A self scoring dart game as set forth in claim 5 wherein each of said single element conductive areas are positioned on the underside of a dome-like structure moulded in said single element sheet, said dome-like structures being moulded such that each structure will collapse under the force of dart impacting there against and return to its original moulded state upon release of said impacting force.

7. A self scoring dart game as set forth in claim 1 wherein said display means comprises solid state, electronic illuminated digital read out display.

8. A self scoring dart game as set forth in claim 1 wherein said target panel is comprised of a single thin flexible sheet capable of being momentarily deflected by an impacting dart substantially in the area of impact.

9. A self scoring dart game as set forth in claim 1 wherein at least two of said target areas may produce corresponding electrical signals to said logic means.

* * * * *